US007829014B2

(12) United States Patent
Keener

(10) Patent No.: US 7,829,014 B2
(45) **Date of Patent: *Nov. 9, 2010**

(54) METHOD FOR PREPARING PRE-COATED, ULTRA-FINE, SUBMICRON GRAIN TITANIUM AND TITANIUM-ALLOY COMPONENTS AND COMPONENTS PREPARED THEREBY

(75) Inventor: Steven G. Keener, Trabuco Canyon, CA (US)

(73) Assignee: The Boeing Company, Chicago, IL (US)

( * ) Notice: Subject to any disclaimer, the term of this patent is extended or adjusted under 35 U.S.C. 154(b) by 1457 days.

This patent is subject to a terminal disclaimer.

(21) Appl. No.: 10/982,338

(22) Filed: Nov. 5, 2004

(65) Prior Publication Data

US 2006/0099432 A1 May 11, 2006

(51) Int. Cl.
*B22F 1/00* (2006.01)
*B22F 1/02* (2006.01)

(52) U.S. Cl. ..... 419/33; 75/354

(58) Field of Classification Search ..... 419/33, 419/38, 67; 75/354; 148/669; 427/318
See application file for complete search history.

(56) References Cited

U.S. PATENT DOCUMENTS

| | | | | |
|---|---|---|---|---|
| 3,017,299 | A | 1/1962 | Giles et al. | |
| 3,363,846 | A | 1/1968 | Eck | |
| 4,659,268 | A | 4/1987 | Del Mundo et al. | |
| 4,717,302 | A | 1/1988 | Adams et al. | |
| 4,778,637 | A | 10/1988 | Adams et al. | |
| 4,818,481 | A * | 4/1989 | Luton et al. | 419/67 |
| 4,861,211 | A | 8/1989 | Dunsmore | |
| 5,372,663 | A | 12/1994 | Shibue et al. | |
| 5,614,037 | A | 3/1997 | Keener | |
| 5,775,603 | A | 7/1998 | Kohler | |
| 5,858,133 | A | 1/1999 | Keener | |
| 5,922,472 | A | 7/1999 | Keener | |
| 5,944,918 | A | 8/1999 | Keener | |

(Continued)

FOREIGN PATENT DOCUMENTS

| | | |
|---|---|---|
| EP | 0 919 284 | 6/1999 |

(Continued)

OTHER PUBLICATIONS

Bohn et al., "Room Temperature Mechanical Behavior of Silicon-Doped TiAl Alloys with Grain Sizes in the Nano- and Submicron-Range," *Acta Materialia Elsevier UK*, vol. 49, No. 2, Jan. 22, 2001, pp. 299-311.

(Continued)

*Primary Examiner*—Roy King
*Assistant Examiner*—Weiping Zhu
(74) *Attorney, Agent, or Firm*—Alston & Bird LLP

(57) ABSTRACT

The invention is a high-strength, pre-coated, titanium or titanium-alloy material component comprising a titanium or titanium-alloy material article having ultra-fine, submicron grain size microstructure and an organic coating of phenolic resin applied to the surface of the article. The article is prepared from a coarse grain titanium or titanium-alloy powder material that is cryomilled into an ultra-fine, submicron grain material, degassed, and densified. The densified material is formed or otherwise processed into a article, and pre-coated with an organic coating containing phenolic resin prior to installation or assembly.

22 Claims, 4 Drawing Sheets

U.S. PATENT DOCUMENTS

| | | | |
|---|---|---|---|
| 6,171,649 | B1 | 1/2001 | Keener et al. |
| 6,221,177 | B1 | 4/2001 | Keener |
| 6,274,200 | B1 | 8/2001 | Keener et al. |
| 6,403,230 | B1 | 6/2002 | Keener |
| 6,494,972 | B1 | 12/2002 | Keener et al. |
| 6,499,926 | B2 | 12/2002 | Keener |
| 6,638,381 | B2 | 10/2003 | Keener et al. |
| 6,902,699 | B2 | 6/2005 | Fritzemeier et al. |
| 2004/0177723 | A1 | 9/2004 | Van Daam |

FOREIGN PATENT DOCUMENTS

| | | |
|---|---|---|
| EP | 1 321 199 | 6/2003 |

OTHER PUBLICATIONS

Fanta, et al., "The Effect of Ultrafine Grained Microstructures on the Hot-Workability of Intermetallic/Ceramic Composites Based on γ-TiAl," *Intermetallics*, vol. 9, No. 1, Jan. 2001; pp. 45-49.

Choi et al., "Consideration Behavior of Nanocrystalline Al-5at%Ti alloys Synthesized by Cryogenic Milling," *Journal of Alloys and Compounds*, vol. 315, Feb. 9, 2001; pp. 178-186.

Bohn et al., "Submicron-grained multiphase TiAlSi alloys: Processing, characterization, and microstructural design," *Journal of Materials Research*, vol. 16, No. 6, Jun. 2001, pp. 1850-1861.

ASM Handbook, vol. 2, Properties and Selection: Nonferrous Alloys and special-Purpose Materials, pp 586-591 and 608-620, ASM International, 1990.

* cited by examiner

METHOD FOR PREPARING PRE-COATED, ULTRA-FINE, SUBMICRON GRAIN TITANIUM AND TITANIUM-ALLOY COMPONENTS AND COMPONENTS PREPARED THEREBY

FIELD OF THE INVENTION

The present invention relates to pre-coated, high-strength titanium-alloy material components, and to the production of pre-coated, high-strength titanium-alloy material components made from cryomilled titanium-alloy materials.

BACKGROUND OF THE INVENTION

Currently, in the fabrication of titanium and titanium-alloy articles, thermal or heat-treating processes are included in the manufacturing process. These steps are to ensure that material grain size associated with the article's microstructure is produced and maintained at a level that is as small as possible. The resulting material grain size of the formed article is critical to both its ductility and strength among other properties. In general, grain sizes larger than or equal to those identified as a number 6, i.e., less than or equal to a number 5 as defined by ASTM E 112 (larger than about 75 μm) are not desirable for most mechanical work or forming operations. As such, it is the normal practice to employ a full annealing, i.e. recrystallization, or at least stress-relieving heat-treatment steps in conjunction with any cold or hot work or forming performed on the article.

There have been exhaustive attempts to eliminate the thermal treatment, or heat treating, manufacturing process steps, which can account for up to approximately 20% of the costs not to mention processing cycle time associated with producing a titanium or titanium-alloy article or fastener, such as either a deformable-shank solid rivet or non-deformable-shank lockbolt, threaded pin, etc.

The heat-treated articles are then typically installed with a wet sealant applied to their surfaces to protect the articles and surrounding structure from corrosion. The process of wet sealing also accounts for a significant portion of the costs of installing metal and metal-alloy components or articles, and represents an extra process step requirement, which slows the installation procedure.

Because heat treatment and wet sealing are both costly and time-consuming steps in the manufacture and installation of titanium and titanium-alloy material articles, it would be desirable to provide a process for forming titanium and titanium-alloy material articles having smaller grain sizes while reducing the number of associated processing steps required. Further, it would be desirable to provide a process of installing titanium and titanium-alloy material articles without having to apply wet sealants.

SUMMARY OF THE INVENTION

The invention provides a pre-coated, high-strength titanium or titanium-alloy material component and method of making that component that may be used as a structural component, and which is preferably used as a fastener component. The component comprises a titanium or titanium-alloy material article having ultra-fine, submicron grain size and an organic coating of phenolic resin applied to the surface of the article. The titanium or titanium-alloy material of the article is produced in a manner that results in increased strength in comparison to previous aluminum-alloy and titanium-alloy material articles, and the pre-coating of the article provides corrosion protection between the adjacent fay-surfaces of the articles that allow the resulting pre-coated component to be an assembled into a structure without the need for wet-sealant materials.

The article is prepared by beginning with a coarse grain titanium or titanium-alloy material and cryogenically milling the coarse grain material into an ultra-fine, submicron grain material. The ultra-fine grain material is then degassed and densified. The densified material is formed into an article using any of several known forming techniques, such as Hot Isostatic Pressing (i.e. HIP) or Ceracon-type forging processes. Finally, the formed article is pre-coated with an organic coating containing phenolic resin.

According to one embodiment, the pre-coated component is formed into a structural component. For example, the structural component could be a wing spar or other structural component used in construction of an aerospace structure. According to another embodiment, the pre-coated component is formed into a fastener component, such as a rivet, nut, bolt, lockbolt, threaded pin, or swage collar. The pre-coated fastener component may be used to join and fasten two objects together, and any such assembly is also contemplated by the invention.

The strength and physical properties of the titanium or titanium-alloy material components are improved over previous aluminum and titanium-alloy material fasteners because the titanium-alloy material is cryomilled along with other associated processing steps prior to formation of the components. Cryomilling is a powder metallurgy process that modifies the chemical and metallurgical structural make-up of metallic materials. When the cryomilling process, i.e., cryogenic milling, is applied to titanium or titanium-alloy powders, the metallic material is reduced and deformed to extremely fine powder consistency and then is eventually re-consolidated. The cryomilling process produces an ultra-fine, submicron grain microstructure in the processed material. As a rule, the finer the grain, the better the formability and other associated characteristics.

The resulting cryomilled titanium or titanium-alloy material has improved material properties, the majority of which are directly dependent upon the ultra-fine submicron grain microstructure, in comparison to currently fabricated articles in which additional thermal or heat-treatment steps are necessary to offset the effects of cold-working imparted to the material during its manufacturing process.

By utilizing the cryogenic milling process, i.e., mechanical alloying of metal powders in a liquid nitrogen slurry, with titanium and titanium-alloy powder metallurgy, ultra-fine grain nanocrystalline-alloy materials are produced that can be further processed in the form of extrusions and forgings. The cryomilling process produces a metallic-material powder having a high-strength, extremely ultra-fine, thermally-stable microstructure. After the cryomilled metal-alloy powder has been degassed and consolidated through either a HIP or 'Ceracon-type' forging or similar process, the resulting nanocrystalline ultra-fine grain microstructure is extremely homogeneous. Once the highly homogeneous, cryomilled metallic-powder material has been consolidated, it may be extruded or drawn into various shapes that can be used as aerospace fasteners or other articles for subsequent use in various aerospace applications.

The processed, nanocrystalline ultra-fine grain material can then be subjected to the normal manufacturing steps associated with typical fasteners or other articles, including cold-working, but not requiring the additional subsequent thermal treatment steps. In contrast, previous manufacturing practices call for considerable efforts involving several additional processing steps to be taken in the thermal or heat-treatment processing of titanium and titanium-alloy materials in order to ensure that the resulting material grain size is maintained at a level that is as small as possible. With the component of the present invention, improved control in the manufacturing process and alloying of the chemical composition allow the resulting mechanical and chemical properties, e.g., elongation and corrosion resistance, to be tailored in order to meet the requirements of high-strength fastener applications better than conventional, heat-treated titanium and titanium-alloy material fasteners, such as standard conventionally-processed Ti-6Al-4V titanium-alloy material. A primary cause of these improved benefits is the absence of coherent precipitation hardening phases that are common in conventional thermal treatments normally utilized in conjunction with titanium-alloy materials. These phases promote plastic strain localization, i.e., cracking, stress corrosion cracking, etc.

After the nanocrystalline-alloy article is formed, the article is subjected to pre-coating with an organic coating containing a phenolic resin to form a pre-coated component. In general, the pre-coating improves fatigue life and corrosion resistance of the pre-coated component. The pre-coating is particularly advantageous when the pre-coated components are used as fasteners because, during subsequent installation, the pre-coated fasteners need not be installed in conjunction with wet sealants, wherein a viscous liquid sealant is applied to the fastener and the surrounding, adjacent surfaces of the components being assembled just before installing the fastener. The elimination of the wet-sealant installation practice offers a significant cost savings. The elimination of the use of wet sealants also improves the workmanship in the fastener installation, as there is no or greatly-reduced possibility of missing some of the fasteners as the wet sealant is applied during installation. Further, elimination of the wet sealant provides additional cost savings related to time delay, equipment, and manpower required for wet-sealant installation, and cost of clean-up and disposal of wet-sealant materials.

The invented pre-coated component and method of making the pre-coated component provide a component with improved strength, corrosion resistance, and ease of manufacture that was previously unavailable. Because the titanium or titanium-alloy material of the component is cryomilled, the metal need not be thermally-treated prior to installation. Because the component is pre-coated, the burdensome use of wet sealant employed during its assembly is avoided. The above advantages translate to decreased installation time and cost in an industrial setting.

BRIEF DESCRIPTION OF THE DRAWINGS

Figure 1:
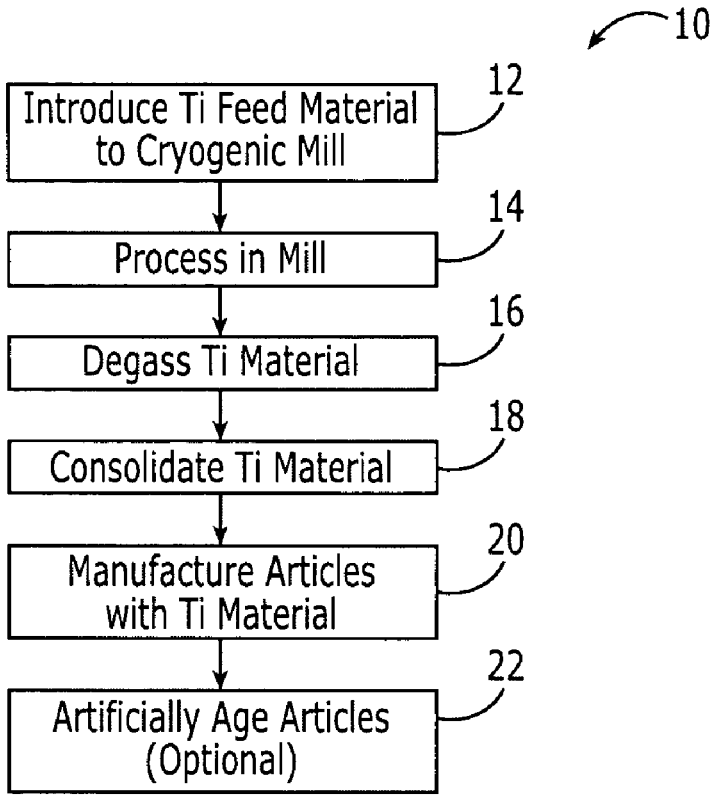
Figure 2:
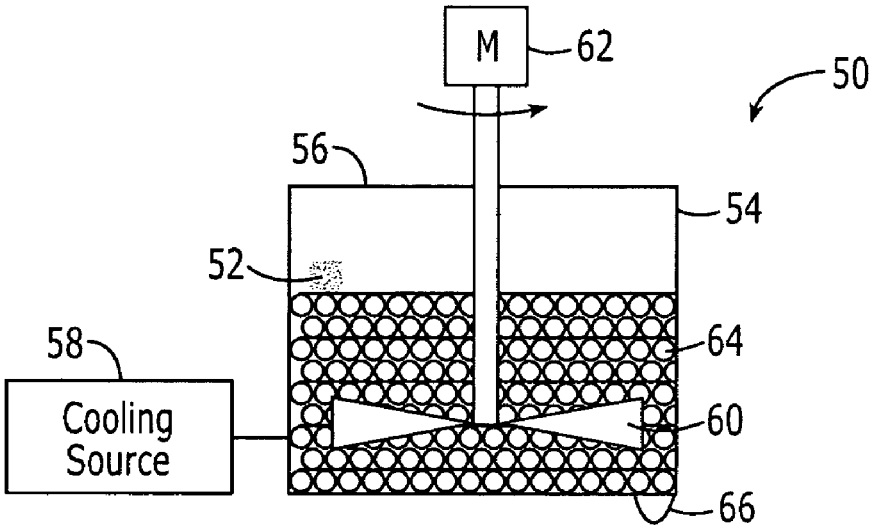
Figure 3A:
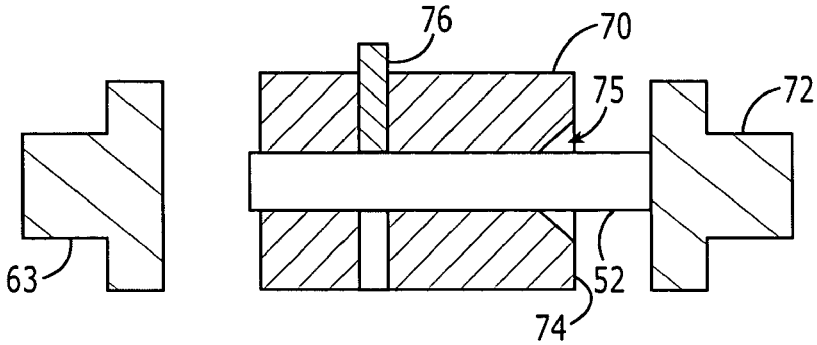
Figure 3B:
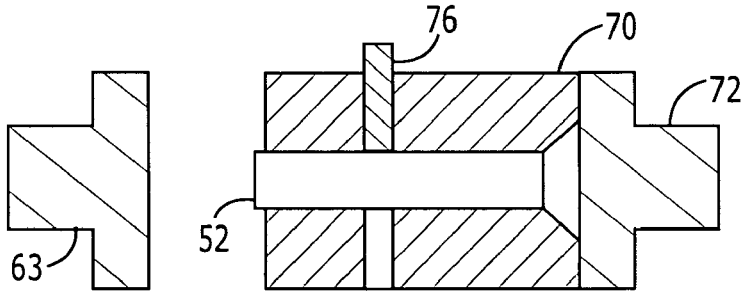
Figure 3C:
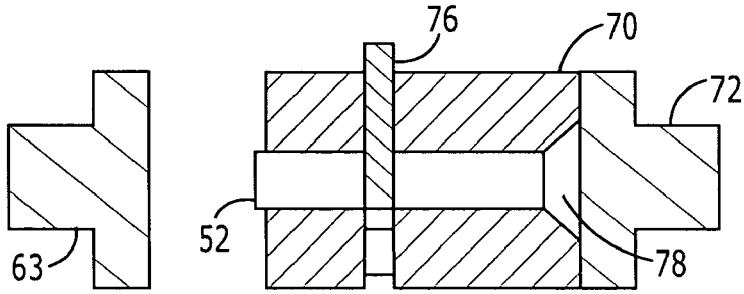
Figure 3D:
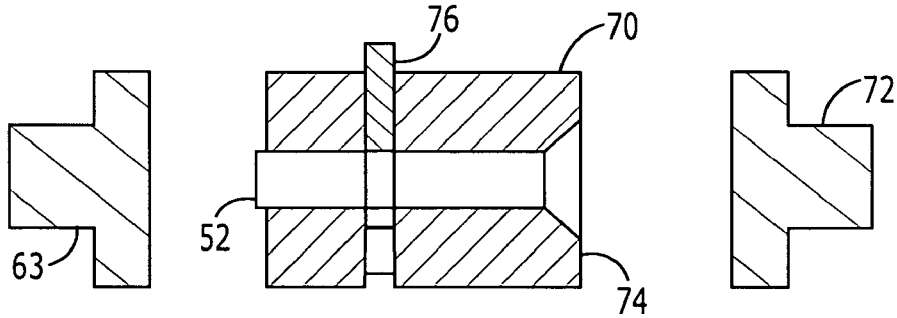
Figure 3E:
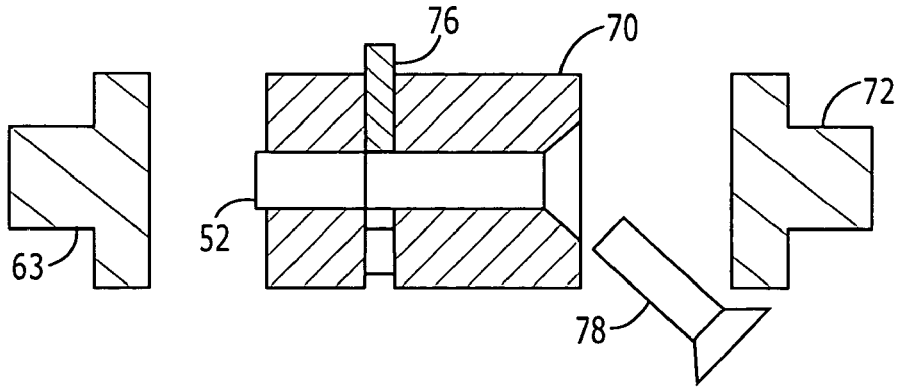
Figure 4:
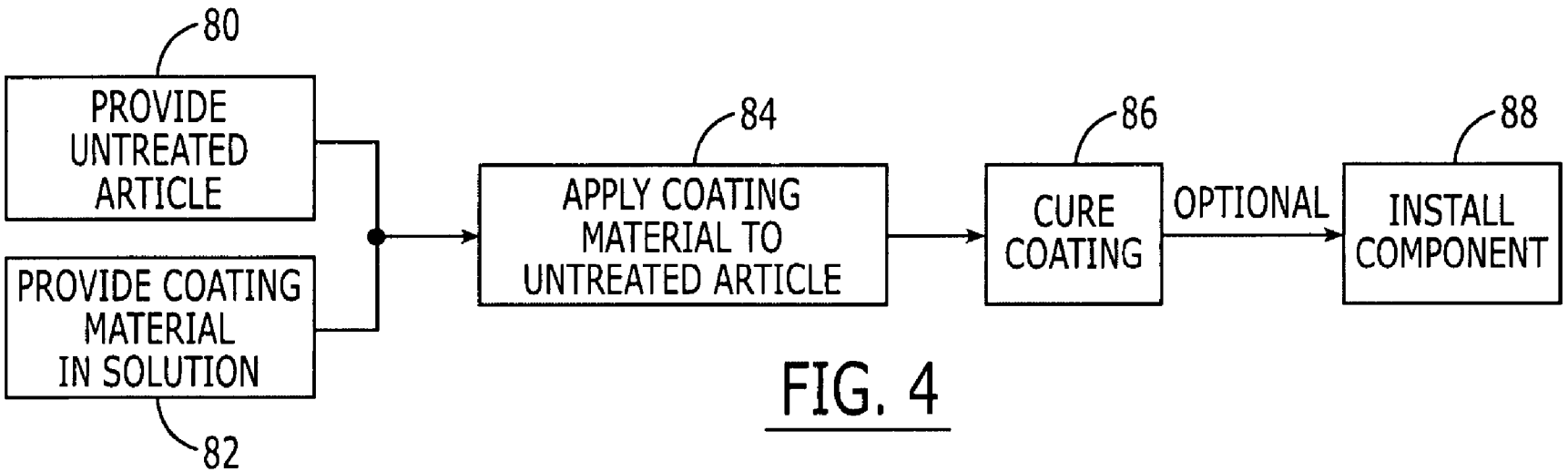
Figure 5:
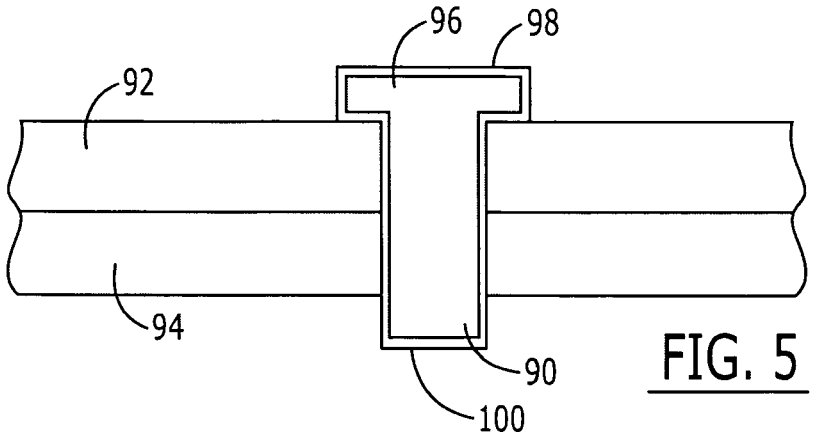
Figure 6:
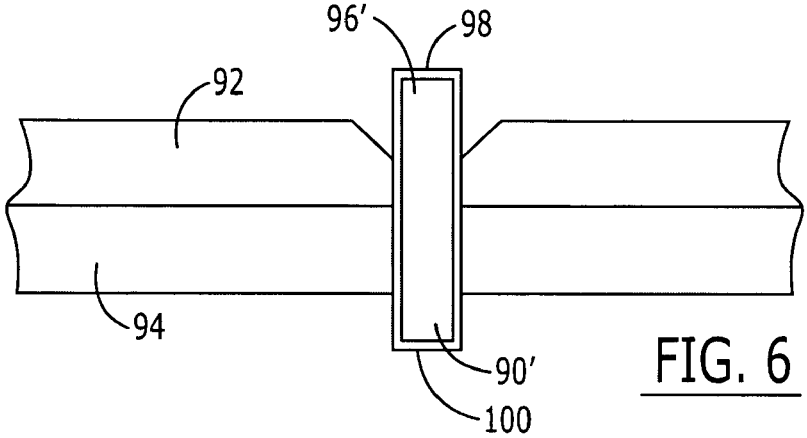
Figure 7:
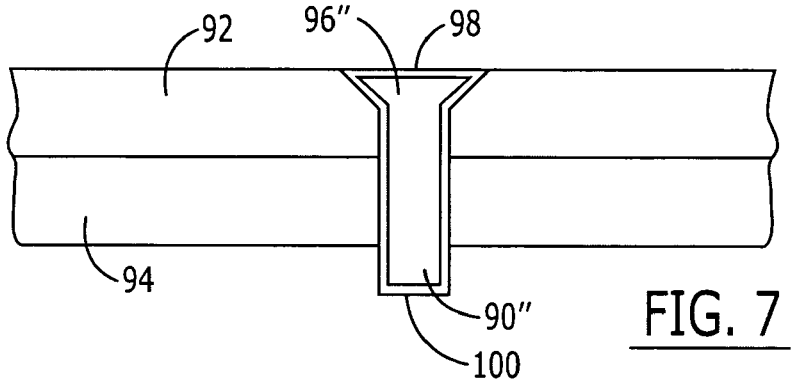
Figure 8:
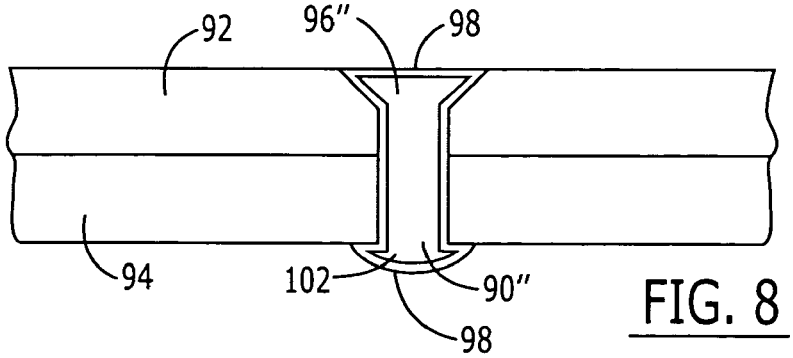

Having thus described the invention in general terms, reference will now be made to the accompanying drawings, which are not necessarily drawn to scale, and wherein:

FIG. 1 is logic flow diagram for producing an ultra-fine, submicron grain titanium or titanium-alloy material article from a titanium or titanium-alloy raw material powder according to one embodiment of the present invention;

FIG. 2 is a sectional view of a high-energy cryogenic, attritor-type ball-milling device used in the mechanical alloying of the titanium or titanium-alloy powder material;

FIGS. 3A-3E are perspective views for forming a fastener by a mechanical cold-forming technique according to one embodiment of the present invention from the ultra-fine, submicron grain titanium or titanium-alloy material;

FIG. 4 is a process flow diagram for the method of pre-coating a formed article or component in accordance with one embodiment of the invention;

FIG. 5 is a schematic sectional view of a protruding-head fastener used to join two pieces, prior to upsetting;

FIG. 6 is a schematic sectional view of a slug fastener used to join two pieces, prior to upsetting;

FIG. 7 is a schematic sectional view of a flush-head fastener used to join two pieces, prior to upsetting; and FIG. 8 is a schematic sectional view of the flush-head fastener of FIG. 7, after upsetting.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout.

As used herein, the term "article" generally refers to a formed metallic object having no pre-coated organic layer, while the term "component" refers collectively to a formed metallic object and a pre-coated organic layer applied to the surface of the article. The terms are used for the convenience of the reader and are not intended to limit the scope of the description or claims.

Referring now to FIG. 1, a logic flow diagram for producing a titanium or titanium-alloy material article having an ultra-fine, submicron grain metallurgical microstructure is shown generally as 10. The process starts in step 12 by introducing a coarse grain titanium or titanium-alloy raw material powder into a high-energy cryogenic, attritor-type ball-milling device. The coarse grain titanium or titanium-alloy material powder listed above may be comprised of any titanium or titanium-alloy material having a majority wt % titanium as is well known in the art. The titanium-alloy materials are advantageously aerospace alloy materials having an ultimate tensile strength of 130,500 $lb/in^2$ or more when measured at 20° C. (68° F.).

Metallic constituents in addition to titanium may be combined into the metal-alloy composition in accordance with the invented milling processes. In particular, preferred alloys of aluminum, molybdenum, vanadium, tungsten, iron, nickel, cobalt, manganese, copper, niobium, and chromium can be used in accordance with the processes of this invention to produce alloys having greater low-temperature strength than corresponding dispersion strengthened titanium or titanium-alloy materials and other titanium or titanium-alloy materials formed by methods other than by the invented method.

Commercially pure (CP) and binary titanium-alloy materials, such as β-Ti—Mo and α-Ti—Al, including two preferred compositions of Ti-6Al-4V and Ti-5Al-2.5Sn, are specifically addressed by this invention. If the beginning metal powder is supplied as pre-alloyed powder, then it can proceed directly to the cryomilling process. Metal powders that have not been previously alloyed can also proceed to the cryomilling step, since the cryomilling will eventually and intimately mix the constituents and thereby alloy the metal constituents.

The cryogenic milling process including temperature and the introduction of an inert gaseous atmosphere is controlled. The gasses utilized for the inert atmosphere may include argon, helium, and/or nitrogen-either individually or in some combination. The type of gas may be varied as the milling process is conducted. The gases contribute to the formation of oxides of titanium or nitrates of titanium. The temperature is controlled using a super-cooled liquid gas source, such as liquid argon or liquid nitrogen. In one example, the mill is maintained at about −320° F.

In step 14, the initial, coarse grain titanium or titanium-alloy raw material powder is introduced into the mill. It is preferred to handle the starting metal powders in a substantially oxygen-free atmosphere. For instance, the titanium or titanium-alloy powder material is preferably supplied by atomizing the titanium or titanium-alloy material from a titanium or titanium-alloy source and collecting and storing the atomized titanium or titanium-alloy powder in a container under an argon or other inert gaseous atmosphere. The titanium or titanium-alloy powder is held in the argon or similar inert atmosphere, such as a dry nitrogen atmosphere, throughout all handling, including the operation of mixing the titanium or titanium-alloy powder with any additional metal constituents prior to milling. Holding the raw titanium or titanium-alloy powder within an inert atmosphere comprised of argon, helium, and/or nitrogen—either individually or in some combination—prevents the surface of the titanium or titanium-alloy components from excessive oxidation. The inert atmosphere also prevents contaminants such as moisture from reacting with the raw metal powder. Since magnesium and other metals readily oxidize, they are treated in the same manner as titanium or titanium-alloy powders prior to milling. Thus, the titanium or titanium-alloy and other metallic powders are preferably supplied uncoated, meaning without a coating of metal oxides.

The metallic powder mixture or slurry is then processed by stirring, preferably using a medium such as stainless steel or ceramic balls, within the high-energy cryogenic, attritor-type ball-milling device to fully homogenize the raw feed stock material and to impart severe mechanical deformation to produce an ultra-fine, submicron grain microstructure.

Referring now to FIG. 2, a sectioned view of a high-energy attritor-type, cryogenic ball-milling device is shown generally as 50. A quantity of coarse grain, titanium or titanium-alloy powder material 52 is introduced to a stirring chamber 54 through an input 56. The titanium or titanium-alloy material 52 having an initial grain size of about 0.01 mm to about 0.1 mm, and advantageously of about 0.03 mm to about 0.05 mm, is preferably introduced into the cryogenic milling device in conjunction with liquid nitrogen at about a temperature of −320° F. (−196° C.) to form a slurry mixture. The temperature of the slurry mixture and the milling device is maintained by using an external cooling source 58, such as liquid nitrogen. Thus, the milling device and its contents are super-cooled to about the temperature of the liquid nitrogen temperature and held at approximately that temperature during the milling process. Of course, other gases such as liquid helium or argon may be used in the slurry mixture inside the milling device and for cooling the device itself. Different cooling materials may be used and may be varied by type or percent composition during the cryomilling process. Liquid nitrogen is preferred because it may provide additional strength and high temperature stabilization by the creation of nitrides in the agglomerates. Using a different liquid gas may result in a titanium-alloy material that does not have the benefits associated with the metal nitrides in the resulting microstructure. Further, stearic acid (about 0.20% by weight) may be introduced into the attritor-type ball-milling device to provide lubricity for the milling process. It promotes the fracturing and re-welding of metal particles during milling, leading to more rapid milling, and enables to a larger percentage of milled powder to be produced during a given processing period.

The stirring chamber 54 of the attritor 50 has a stirring rod 60 coupled to a motor 62 or similar rotational device that controls the rotational rate. The titanium or titanium-alloy powder material 52 contacts the milling medium, such as stainless steel balls 64, disposed within the chamber 54. The stirring rod or rotating impeller 60 moves the stainless steel balls 64 to achieve the severe mechanical deformation needed to reduce the grain size of the titanium or titanium-alloy powder material 52 by stirring, grinding, or milling action. For typical titanium-alloy material powder, the rotational rate or speed is held constant at approximately 100 revolutions per minute (RPM) to about 300 RPM for a period of at least 8 hours. By the constant mixing and severe mechanical deformation that is achieved by the moving stainless steel balls 64, the titanium or titanium-alloy powder material 52 is moved through the stirring chamber 54 to produce metallurgical structure having ultra-fine, submicron grain size. Once complete, the powder material exits through an outlet 66 or is otherwise removed.

Once removed from the stirring chamber, the titanium or titanium-alloy powder material is mechanically deformed into flat or semi-rounded agglomerates typically having a high-level of nitrogen in addition to carbon and hydrogen obtained from the presence of the stearic acid. Also, there may be a relatively high iron content as a result of the contamination generated through contact with the stainless steel ball medium during the cryomilling process. The metallurgical grain size is reduced to preferably between approximately 100 nanometers (nm) and about 500 nm as a result of the cryogenic mixing process. More preferably, the range of the resulting metallurgical grain size may be approximately 100 nm to about 300 nm. These grain sizes correspond to normally accepted grain sizes of less than 6 as defined by ASTM E 112.

The stirring rate and length of time within the cryogenic milling device is dependent upon the type and amount of material introduced to the device, the titanium or titanium-alloy material within the device, and the size of the chamber used for mixing the titanium or titanium-alloy material. In one embodiment, the speed of the attritor was from approximately 100 RPM to about 300 RPM for roughly 8 hours.

Referring again to FIG. 1, in step 16, the homogenized, agglomerated raw material powder is degassed. This may be performed in a separate device after removal from the cryogenic, attritor-type ball-milling device. The degassing is an important step for eliminating gas contaminates that jeopardize the outcome of subsequent processing steps on the resulting material quality and may take place in a high vacuum, turbomolecular pumping station. The degassing process occurs in a nitrogen atmosphere, typically at approximately +850° F. in a vacuum of approximately $10^{-5}$ Torr for period of about 72 hours minimum. The ultra-fine grain size of the metallurgical microstructure has the unique and useful property of being stable on annealing to temperatures of about 850° F. This enables the powder to endure the relatively high temperatures experienced during degassing and consolidation while maintaining the ultra-fine grain size metallurgy that contributes to increased strength.

In step 18, after removal from the cryogenic milling device and degassing, the powder material is consolidated to form a titanium or titanium-alloy material having an ultra-fine, submicron grain size metallurgical microstructure. As used herein, the terms ultra-fine, submicron, and nanocrystalline refer to metals having average grain sizes less than 1 micron, advantageously from about 100 nm to about 500 nm, and further advantageously from about 100 nm to about 300 nm. The consolidation may take the form of hot isostatic pressing (HIPing). By controlling the temperature and pressure the HIPing process densifies the material. An exemplary HIPing process would be approximately +850° F. under a pressure of about 15 KSI for approximately 4 hours. The consolidation or densification process may take place in a controlled, inert atmosphere such as in a nitrogen or an argon gas atmosphere. Other processing techniques, such as a Ceracon-type, non-isostatic forging process, may be used. The Ceracon-type forge process allows an alternative, quasi-hydrostatic consolidation process to the hot isostatic press (HIP) process step.

In step 20, the resulting titanium or titanium-alloy ultra-fine, submicron grain microstructure, is then subjected to normal manufacturing steps associated with typical aerospace articles, such as fasteners, including but not limited to mechanical cold- or hot-working and cold- or hot-forming, but not requiring the associated thermal or heat-treatment steps. This is shown further below in FIGS. 3A-3E.

One benefit of the ultra-fine grain microstructure material produced in accordance with this invention is that no subsequent thermal treatments are necessary in most applications. A subsequent thermal treatment may be performed, however, when necessary. In step 22, the formed articles 78 may be optionally subjected to an artificially-aging thermal treatment in a suitable oven for a pre-determined amount of time. For commercially pure (CP) titanium material, the titanium material is placed in a suitable oven for approximately 12 hours at between approximately 900° F. and 950° F. The articles are then available for use. For the aerospace industry, these articles include fasteners, such as rivets, threaded pins, lockbolts, etc., and other small parts, such as shear clips and brackets, for use either on spacecraft, aircraft, or other associated airframe article assemblies.

As described in FIGS. 3A-3E below, the ultra-fine, submicron grain titanium or titanium-alloy material 52 may then be further processed by a hot- or cold-forming technique to form a fastener 78 according to one preferred embodiment of the present invention. Thus, there is no requirement of subsequent thermal treatments.

As shown in FIG. 3A-3E, an exemplary method of forming the titanium or titanium-alloy material into an article, here a fastener, is shown. The titanium or titanium-alloy ultra-fine, submicron grain material is first inserted into the die using a ram 63. The titanium or titanium-alloy material 52 is then shaped within the cold-forming die 70 by a forming or heading ram 72. The forming or heading ram 72 will reactively push against the titanium-alloy material 52 until it abuts against the outer surface 74 of the die 70, thereby completely filling the inner cavity 75 of the die 70 with the titanium or titanium-alloy material 52. Next, a shear device 76 or similar cutting device cuts the titanium or titanium-alloy material 52, thereby forming the fastener 78. The forming or heading ram 72 and the shear piece 76 then retract or withdraw to their normal positions and the formed fastener 78 is removed from the cavity 75 of the die 70. The fastener 78 may then be subsequently processed as is well known in the art to form the finished part.

Of course, while FIG. 3A-3E show one possible manufacturing method for forming a fastener 78, other manufacturing techniques that are well known in the art may be used as well. For example, the fastener 78 may be made using a cold-working technique. Further, while FIGS. 3A-3E show the formation of a fastener 78, other types of fasteners or articles may use any one of a number of similar manufacturing techniques. These include, but are not limited to, two-piece, non-deformable-shank fasteners, such as threaded pins and lockbolts, and one-piece, deformable-shank fasteners, such as rivets.

The fasteners, such as rivets, made from the ultra-fine, submicron grain titanium or titanium-alloy material have improved ductility and fracture toughness over prior art titanium or titanium-alloy fasteners. Enhanced metallurgical stability is also achieved at elevated temperatures due to the mechanical cold working achieved with the metallurgical microstructure as a result of the cryogenic milling process. These fasteners are especially useful in applications such as required in the aerospace industry. Additionally, the elimination of the thermal or heat treatment step eliminates sources of error and costs associated with the various thermomechanical processing steps. For example, the elimination of the thermal treatment alone is believed to save approximately 20% of the cost of manufacturing a fastener used in aerospace applications. Furthermore, reduced processing time by the elimination of the thermal treatment process is achieved in the overall manufacturing cycle time of the fastener.

The solid rivets produced from the ultra-fine grain metallurgical structure material generally have an extremely high yield strength, between about 73 ksi and about 104 ksi, and ultimate tensile strength, between about 78 ksi and about 107 ksi. More importantly, the metallic alloys may have the same or higher yield strength at low temperatures, ranging from about 67 ksi to about 126 ksi at −320° F., and ranging from about 78 ksi to about 106 ksi at −423° F. Similarly, the ultimate tensile strength of the alloys may range from about 78 ksi to about 129 ksi at −320° F. and from about 107 ksi to about 121 ksi at −423° F.

After formation of the article, the article is pre-coated with an organic coating material. As depicted in FIG. 4, an untreated article is first provided 80. A coating material is provided, numeral 82, preferably in solution so that it may be readily and evenly applied. The usual function of the coating material is to protect the base metal to which it is applied from corrosion, including, for example, conventional environmental corrosion, galvanic corrosion, and stress corrosion. The coating material is a formulation that is primarily of an organic composition, but which may contain additives to improve the properties. It is desirably, initially dissolved in a carrier liquid so that it can be applied to a substrate. After application, the coating material is curable to effect structural changes within the organic article, typically cross-linking of organic molecules to improve the adhesion and cohesion of the coating.

A wide variety of curable organic coating materials are available. A typical and preferred coating material of this type has phenolic resin mixed with one or more plasticizers, other organic compounds such as polytetrafluoroethylene, and inorganic additives such as aluminum powder and/or strontium chromate. These coating materials are preferably dissolved in a suitable solvent present in an amount to produce a desired application consistency. For the coating material just discussed, the solvent is a mixture of ethanol, toluene, and methyl ethyl ketone (MEK). A typical sprayable coating solution has about 30 weight percent ethanol, about 7 weight percent toluene, and about 45 weight percent methyl ethyl ketone as the solvent; and about 2 weight percent strontium chromate, about 2 weight percent aluminum powder, balance phenolic resin and plasticizer as the coating material. A small amount of polytetrafluoroethylene may optionally be added. Such a product is available commercially as "Hi-Kote 1™" from Hi-Shear Corporation, Torrance, Calif. It has an elevated temperature curing treatment of about 1 hour to 4 hours at approximately +350° F. to +450° F., as recommended by the manufacturer. More preferably, the elevated temperature cure is from 1 hour to 1.5 hours at between +400° F. and +450° F.

The coating material is applied to the untreated article, numeral 84. Either a light abrasive clean, preferably glass bead media versus standard abrasive media, or chemical degrease or passivation step is used to clean the surface of oil, dirt, etc. Any suitable approach, such as dipping, spraying, or brushing, can be used. In the preferred approach, the solution of coating material dissolved in solvent is sprayed onto the article. The solvent is removed from the as-applied coating by drying, either at ambient or slightly elevated temperature, so that the pre-coated article is dry to the touch. The coated component is not suitable for service at this point, because the coating is not sufficiently adhered to the titanium or titanium-alloy base metal and because the coating is not sufficiently coherent or cross-linked to resist mechanical damage in service.

The coating may be cured at room temperature or above, but is preferably heated to a suitable elevated temperature, numeral 86 to cure the coating to its final bonded state. The preferred standard elevated temperature cure treatment, as recommended by the manufacturer, Hi-Shear Corporation, is from about I hour to about 1.5 hours at approximately 400° F.±25° F.

The final coating 98, shown schematically in FIGS. 5-8, is strongly adherent to the base metal and is also strongly coherent and internally cross-linked. In FIGS. 5-8, the thickness of the coating 98 is exaggerated so that it is visible. In reality, the coating 98 is typically about 0.0003 inch to about 0.0005 inch thick after curing in step 86, regardless of the substrate material.

The pre-coated, i.e. coated prior to installation, component is ready for installation, numeral 88. In the case of a fastener, the fastener is installed in the manner appropriate to its type. In the case of a fastener 90, the fastener is placed through aligned bores in the two pieces 92 and 94, as shown in FIG. 5. The protruding remote end 100 of the rivet 90 is upset (plastically deformed) so that the pieces 92 and 94 are captured between the pre-manufactured head 96 and a formed head 102 of the rivet. FIG. 8 illustrates the upset rivet 90" for the case of the flush head rivet of FIG. 7, and the general form of the upset rivets of the other types is similar. The coating 98 is retained on the rivet even after upsetting, as shown in FIG. 8.

The installation step reflects one of the advantages of the present invention. If the coating were not applied to the fastener, it would be necessary to place a viscous wet-sealant material into the bores and onto the faying surfaces as the rivet is installed and prior to being upset, to coat the adjacent surfaces. The wet-sealant material is messy and difficult to work with, and necessitates extensive clean-up of tools and the exposed surfaces of the pieces 92 and 94 with caustic chemical solutions after installation of the rivet is completed. Moreover, it has been observed that the presence of residual wet sealant inhibits the adhesion of later-applied epoxy primer or topcoat paint over the rivet heads. The present pre-coating approach overcomes both of these problems. Wet-sealant material is not needed or used during fastener installation. The later-applied epoxy primer or topcoat paint adheres well over the pre-coated rivet head.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for making a pre-coated ultra-fine, submicron grain titanium or titanium-alloy component comprising the steps of:

providing a titanium or titanium-alloy material having a first grain size;

cryogenically milling the titanium or titanium-alloy material into an ultra-fine, submicron grain material having a second grain size less than the first grain size;

densifying the ultra-fine, submicron grain material to form a densified ultra-fine grain material;

forming an article from said densified ultra-fine, submicron grain titanium or titanium-alloy material; and, coating the article with an organic coating containing phenolic resin.

2. The method of claim 1, wherein the step of forming is performed without subsequent thermal processing.

3. The method of claim 1, further comprising the step of thermal processing after forming.

4. The method of claim 1, wherein the ultra-fine, submicron second grain size material is in the nanocrystalline range.

5. The method of claim 1, wherein the step of densifying the ultra-fine, submicron grain material to form a densified ultra-fine, submicron grain material comprises hot isostatic pressing the ultra-fine, submicron grain material to form a densified ultra-fine, submicron grain material.

6. The method of claim 1, wherein the step of densifying the ultra-fine, submicron grain material to form a densified ultra-fine, submicron grain material comprises Ceracon-type forge consolidating the ultra-fine, submicron grain material to form a densified ultra-fine, submicron grain material.

7. The method of claim 1, wherein densifying comprises densifying the material in an at least partially nitrogen atmosphere.

8. The method of claim 1, wherein the step of densifying comprises densifying the material in an at least partially argon atmosphere.

9. The method of claim 1, wherein forming comprises extruding.

10. The method of claim 1, wherein said titanium-alloy material is composed of a material selected from the group consisting of commercially pure Ti, Ti-6Al-4V, Ti-5Al-2.5Sn,β-Ti—Mo, and α-Ti—Al.

11. The method of claim 1, wherein the step of cryogenically milling comprises cryogenically milling until the grain material is sized to about 100 nm to about 500 nanometers.

12. The method of claim 11, wherein the step of cryogenically milling comprises cryogenically milling until the grain material is sized to about 100 to about 300 nanometers.

13. The method of claim 1, wherein the step of cryogenically milling is performed in an at least partially nitrogen atmosphere or at least partially argon atmosphere.

14. The method of claim 1, wherein the steps of milling comprise:

introducing said titanium or titanium-alloy material to a stirring chamber of a cryogenic milling device;

contacting said titanium or titanium-alloy material with a milling medium for a pre-determined amount of time sufficient to impart mechanical deformation into said coarse-grained titanium or titanium-alloy material to form an ultra-fine, submicron grain structure on said titanium or titanium-alloy material; and removing said ultra-fine, submicron grain titanium or titanium-alloy material from said stirring chamber.

15. The method of claim 14, wherein the step of providing a titanium or titanium-alloy material having a first grain size comprises the step of providing a coarse-grain titanium or titanium-alloy material having a grain size of approximately 0.05 millimeters.

16. The method of claim 14, wherein the step of forming an article from said densified ultra-fine, submicron grain titanium or titanium-alloy material comprises the step of cold-working an article from said ultra-fine, submicron grain titanium or titanium-alloy material.

17. The method of claim 1, further comprising the steps of:

introducing the densified ultra-fine, submicron grain titanium or titanium-alloy material within a cavity of a mechanical cold-forming die, said cavity having the general shape of a fastener;

cutting said formed and densified ultra-fine, submicron grain titanium or titanium-alloy material; and, removing said cut, formed, and densified ultra-fine, submicron grain titanium or titanium-alloy material from said cold-forming die.

18. The method of claim 17, further comprising the step of fastening a first aerospace structure to a second aerospace structure using the coated fastener article.

19. The method of claim 1, wherein the step of coating the article comprises providing a corrosion-resistant, curable organic coating material, the coating material comprising a phenolic resin and an organic solvent;

applying the organic coating material to the formed article; and, curing the coating by allowing the solvent to volatilize.

20. The method of claim 1, further comprising the step of degassing the ultra-fine, submicron grain aluminum or aluminum-alloy material subsequent to milling but prior to densifying the material.

21. The method of claim 1, wherein the recited steps of densifying and forming are accomplished by a single process operation.

22. The method of claim 1, wherein the recited steps of densifying and forming are accomplished by distinct process operations.

* * * * *